United States Patent [19]

Fukao et al.

[11] Patent Number: 5,013,501

[45] Date of Patent: May 7, 1991

[54] METHOD OF PRODUCING CERAMIC MANIFOLDS FOR THERMALLY INSULATING EXHAUST CHANNELS

[75] Inventors: Kaname Fukao, Inuyama; Toshiyuki Hamanaka, Suzuka; Takashi Harada, Nagoya, all of Japan

[73] Assignee: NGK Insulators, Ltd., Aichi, Japan

[21] Appl. No.: 454,381

[22] Filed: Dec. 21, 1989

[30] Foreign Application Priority Data

Dec. 21, 1988 [JP] Japan ..... 63-322890

[51] Int. Cl.[5] ..... B28B 11/00; B28B 1/26

[52] U.S. Cl. ..... 264/67; 264/86; 264/154

[58] Field of Search ..... 264/67, 86, 87, 138, 264/154; 425/84, 85

[56] References Cited

U.S. PATENT DOCUMENTS 2,914,834 12/1959 Daniel ..... 264/138

4,676,064 6/1987 Narita et al. ..... 60/272

4,882,111 11/1989 Murata ..... 264/87

*Primary Examiner*—James Lowe

*Assistant Examiner*—Christopher A. Fiorilla

*Attorney, Agent, or Firm*—Parkhurst, Wendel & Rossi

[57] ABSTRACT

In a method for effectively producing ceramic manifolds for thermally insulating exhaust channels, an intermediate product is first formed by drain casting which includes a main ceramic pipe having a plurality of branch pipes extending therefrom whose ends are connected together by elongated connection members in the form of thin plates or bars. Thereafter, the intermediate product is fired and the ends of the branch pipes are then cut off together with the connection members. In this manner, even ceramic pipes complicated in shape readily can be produced by preventing strains and deformations which would otherwise occur during firing of the intermediate product.

6 Claims, 2 Drawing Sheets

METHOD OF PROUDCING CERAMIC MANIFOLDS FOR THERMALLY INSULATING EXHAUST CHANNELS

BACKGROUND OF THE INVENTION

This invention relates to a method of producing ceramic manifolds having at ends thereof of a plurality of branch pipes to be used for thermally insulating exhaust channels of gasoline engines, diesel engines and the like.

Ceramic pipes such as port liners for thermally insulating exhaust channels or exhaust manifold liners have openings on an engine side and an exhaust pipe side, respectively, and are used to maintain the temperature of high temperature engine exhaust gases passing therethrough. Such ceramic pipes are generally complicated in shape. Particularly, ceramic pipes for four valve engines (which are more frequently being used) are very complicated in shape and have a plurality of branch pipes extending from ends of the ceramic pipes.

Such ceramic pipes have been produced with split molds by drain casting. Even though they are formed in exact shapes, they are likely to deform during firing after the forming process. Particularly, in the case of main ceramic pipes having a plurality of branch pipes long extending from ends of main pipes, the plural branch pipes deform by gravity so as to change spaces between the branch pipes to make cast-in bonding of the ceramic pipes in cylinder blocks difficult.

SUMMARY OF THE INVENTION

It is an object of the invention to provide a method of producing ceramic manifolds for thermally insulating exhaust channels, which eliminates all the disadvantages of the prior art and is able to produce ceramic pipes complicated in shape having a plurality of branch pipes extending from an end of the ceramic pipe without any risk of strains and deformations occurring in the ceramic pipe during firing.

In order to achieve that object, a method of producing ceramic manifolds for thermally insulating exhaust channels according to the invention comprises the steps of forming by drain casting an intermediate product including a main ceramic pipe having a plurality of branch pipes extending therefrom whose ends are connected together by at least one elongated connection member, and cutting off the ends of the branch pipes together with the elongated connection member after firing.

According to the invention the plurality of branch pipes are connected by elongated connection members to prevent strains which would occur during firing, thereby facilitating production of complicated ceramic pipes.

The invention will be more fully understood by referring to the following detailed specification and claims taken in connection with the appended drawings.

DETAILED DESCRIPTION OF THE PREFERRED EMBODIMENTS

Figure 1:
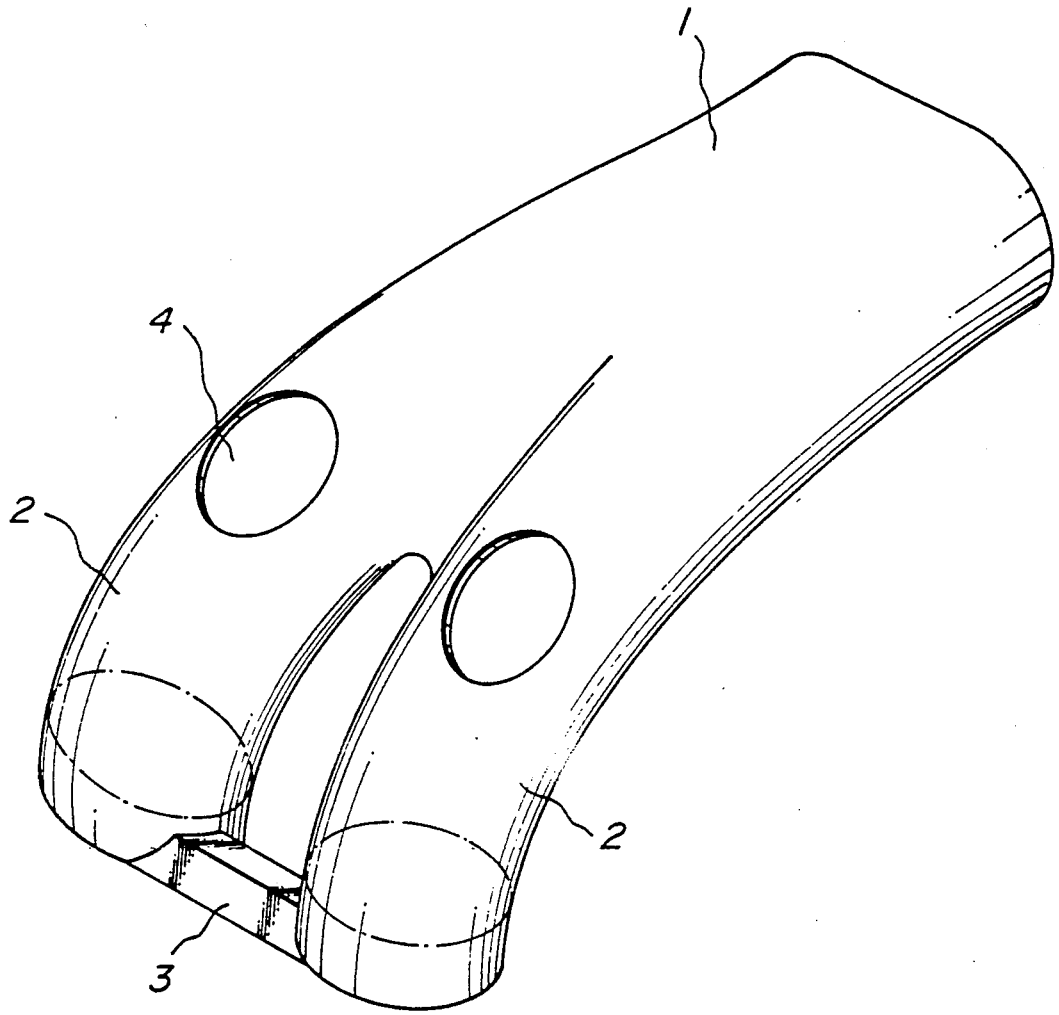
FIG. 1 is a perspective view illustrating an intermediate product for producing a port liner according to the invention.

FIG. 1 illustrates an intermediate product produced when a ceramic port liner is produced according to the invention. The intermediate product comprises a main ceramic pipe 1 having a plurality of branch pipes 2 extending from the main ceramic pipe 1 in the form of a fork. Ends of the branch pipes 2 are connected together by a connection member 3 in the form of an elongated thin plate. Such an intermediate product formed in the shape as above described can be integrally formed by pouring a slurry of a ceramic material, such as aluminum titanate, into a cavity of a mold and draining an excessive slurry from the mold after the poured slurry has adhered in predetermined thicknesses on inner surfaces of the mold in a conventional method known as "drain casting". In the molding, it is preferable to pour and drain the slurry through valve holes 4 formed in upper portions of the branch tubes 2.

The intermediate product shown in FIG. 1 is fired together with the connection member 3 fixed thereto which serves to prevent the plurality of branch pipes 2 from moving toward and away from each other to maintain constant distances between the branch pipes 2 during firing. After firing, the ends of the branch pipes 2, including the connection member 3 are removed from the main pipe 1 by cutting along phantom lines to obtain a ceramic port liner in an exact configuration. Moreover, in the event that respective openings of the intermediate product on an engine side and an exhaust pipe side are formed integrally with closures for the openings and the closures are cut away after firing, any strains in shape of the openings are also prevented.

Figure 2:
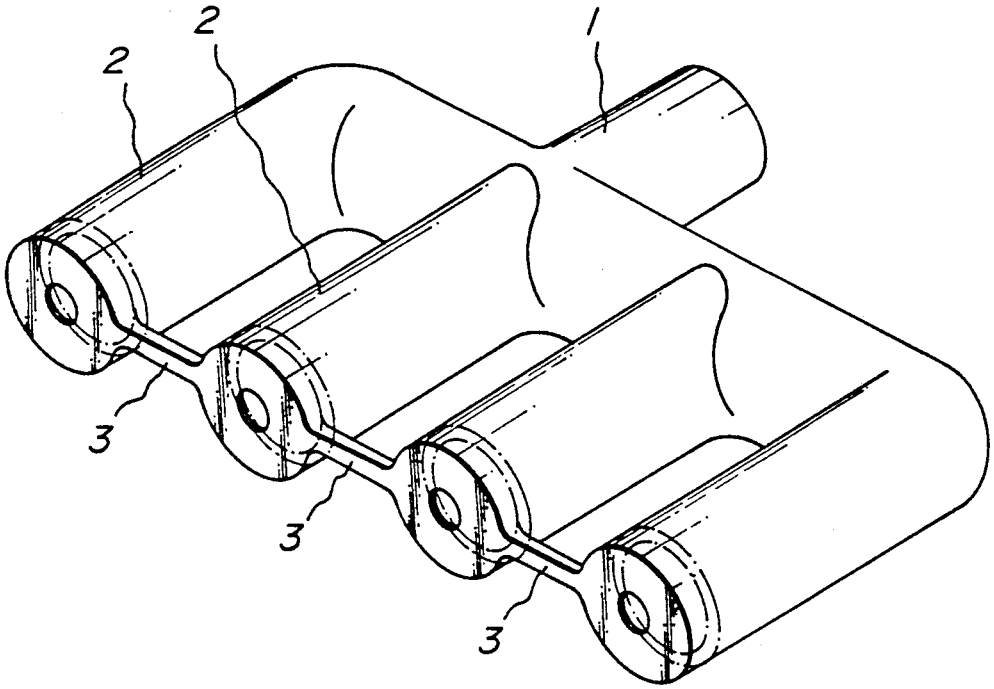
FIG. 2 is a perspective view illustrating an intermediate product for producing an exhaust manifold according to the invention.

FIG. 2 illustrates an intermediate product when an exhaust manifold liner is produced according to the invention. As the intermediate product shown in FIG. 2 is to be used for an exhaust manifold for a four cylinder engine, four branch pipes 2 extend from a main ceramic pipe 1. These branch pipes 2 are connected together by bar connection members 3 as shown. Ends of the branch pipes 2 are cut off along phantom lines in the same manner as in the first embodiment. The exhaust manifold liner produced in this manner is superior in dimensional accuracy and maintains distances between the branch pipes 2 without any change because no strains occur during firing.

The invention is characterized in connecting together the ends of a plurality of branch pipes 2 by bar-shaped or plate-shaped connection members 3. If the connection members have cross-sections which are too small, deformations of the branch pipes during firing cannot be completely prevented. However, excessive cross-sections of the connection members will unduly restrain entire contraction or shrinkage so as to cause strains in the product. Therefore, with parts of automobile engines of normal sizes, connections having thicknesses of the order on 5 mm and widths on the order of 5–10 mm sufficiently accomplish the effects of the invention.

Ceramic materials to be used in the invention are not limited to any particular ceramic material. However, aluminum titanate used in the embodiments is preferable. A ceramic pipe made of aluminum titanate can be freely deflected owing to an elasticity of its material even when the ceramic pipe is insert-cast in a cylinder block. Therefore, there is no risk of cracks occurring in the ceramic pipe due to shrinkage during cooling.

As can be seen from the above explanation, according to the invention an intermediate product including a plurality of branch pipes having ends connected together by connection members is formed by drain casting and the ends of the branch pipes are cut off after firing, thereby preventing strains which would otherwise occur during firing. In this manner, ceramic pipes complicated in shape readily can be produced. The method according to the invention is suitable for producing port liners for four cylinder engines and exhaust manifold liners for multi cylinder engines. Therefore, the invention greatly contributes to improvement of industries as a method of producing ceramic manifolds for thermally insulating exhaust channels which eliminates all the disadvantages of the prior art.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A method of producing a ceramic manifold for thermally insulating exhaust channels, comprising the steps of forming by drain casting an intermediate product including a main ceramic pipe having a plurality of branch pipes extending therefrom whose ends are integrally connected together by at least one elongated connection member to maintain a constant spacing between the branch pipes during firing, firing the intermediate product, and cutting off the ends of the branch pipes together with the at least one elongated connection member.

2. A method as set forth in claim 1, wherein said elongated connection member is a thin plate.

3. A method as set forth in claim 1, wherein said elongated connection member is a bar.

4. A method as set forth in claim 1, wherein said connection member has a thickness on the order of 5 mm and a width on the order of 5–10 mm.

5. A method as set forth in claim 1, wherein said ceramic manifold comprises aluminum titanate.

6. A method as set forth in claim 1, wherein in forming the intermediate product by drain casting, at least one opening of the product is formed integrally with a closure for the opening, and the closure is cut away after firing.

* * * * *